US010059481B2

(12) United States Patent
Ferrone

(10) Patent No.: US 10,059,481 B2
(45) Date of Patent: Aug. 28, 2018

(54) SET OF STACKABLE BOTTLES

(71) Applicant: Felicia Ferrone, Chicago, IL (US)

(72) Inventor: Felicia Ferrone, Chicago, IL (US)

(73) Assignee: fferrone design, ltd., Chicago, IL (US)

( * ) Notice: Subject to any disclaimer, the term of this patent is extended or adjusted under 35 U.S.C. 154(b) by 0 days.

(21) Appl. No.: 14/640,442

(22) Filed: Mar. 6, 2015

(65) Prior Publication Data

US 2015/0251793 A1 Sep. 10, 2015

Related U.S. Application Data

(60) Provisional application No. 61/949,875, filed on Mar. 7, 2014.

(51) Int. Cl.
*B65D 1/02* (2006.01)
*B65D 21/02* (2006.01)

(52) U.S. Cl.
CPC ..... *B65D 1/0223* (2013.01); *B65D 1/023* (2013.01); *B65D 21/0202* (2013.01); *B65D 21/023* (2013.01); *B65D 21/0209* (2013.01)

(58) Field of Classification Search
CPC .. B65D 21/0202; B65D 1/0223; B65D 1/023; B65D 21/0209
USPC ..... 215/382, 10, 40; 220/DIG. 13, 4.27; D9/523, 526; 206/507
See application file for complete search history.

(56) References Cited

U.S. PATENT DOCUMENTS 844,579 A * 2/1907 Clements ..... B65D 1/0223 215/382
1,773,291 A * 8/1930 Weaver ..... B65D 1/023 215/387
D233,979 S * 12/1974 Latorre ..... D9/523
D256,554 S * 8/1980 Beaver ..... D9/523
4,573,595 A * 3/1986 Mednis ..... B65D 21/0237 206/509
D398,240 S * 9/1998 Willardson ..... D9/523
5,988,460 A * 11/1999 Brecheisen ..... B29C 49/04 222/572
6,070,753 A * 6/2000 Hirst ..... B65D 1/02 215/40
D449,778 S * 10/2001 Legoupil ..... D9/523
D469,017 S * 1/2003 Mauro ..... D9/522
D554,509 S * 11/2007 Ghalebi ..... D9/520
D564,886 S * 3/2008 Ghalebi ..... D9/520
D604,620 S * 11/2009 Rica ..... D9/522
D604,621 S * 11/2009 Rica ..... D9/522
8,763,826 B1 * 7/2014 Smith ..... B65D 1/0223 206/507
8,777,029 B2 * 7/2014 Paredes ..... B65D 1/023 215/382
2007/0157570 A1 * 7/2007 Reeves ..... B65D 1/40 53/446

(Continued)

*Primary Examiner* — Jeffrey Allen
*Assistant Examiner* — Jennifer Castriotta
(74) *Attorney, Agent, or Firm* — McAndrews, Held & Malloy, Ltd.

(57) ABSTRACT

A bottle comprising non-concentric body and neck portions is able to stack more closely and more stably than other bottles traditionally used to carry wine or spirits or other fluids. A bottle may include a sloping aperture that enhances pouring of fluids out of the bottle. A bottle may also include a lateral surface that extends substantially the height of the bottle, which may allow a label to be affixed along substantially the height of the bottle.

19 Claims, 13 Drawing Sheets

(56) References Cited

U.S. PATENT DOCUMENTS

2010/0326952 A1* 12/2010 Corliss ..... B65D 1/02
215/386

* cited by examiner

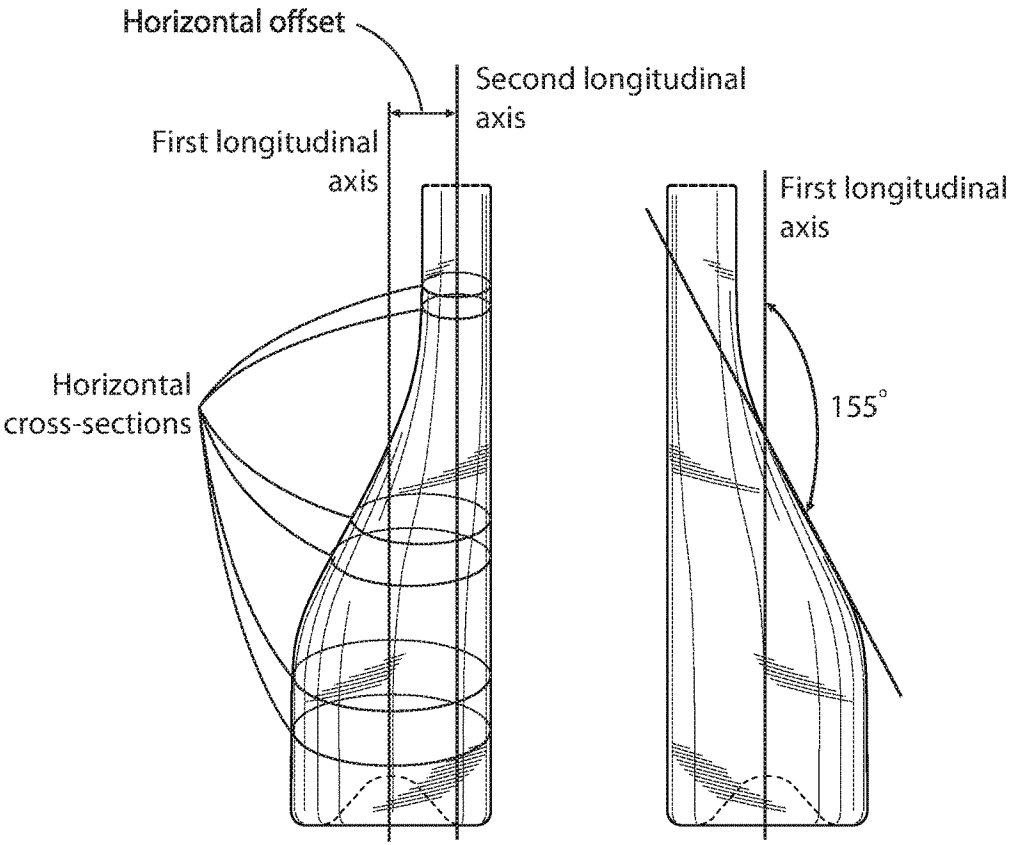
Figure 5
Figure 6
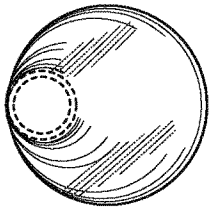
Figure 7
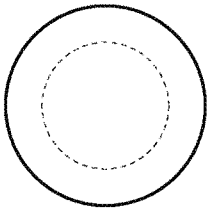
Figure 8

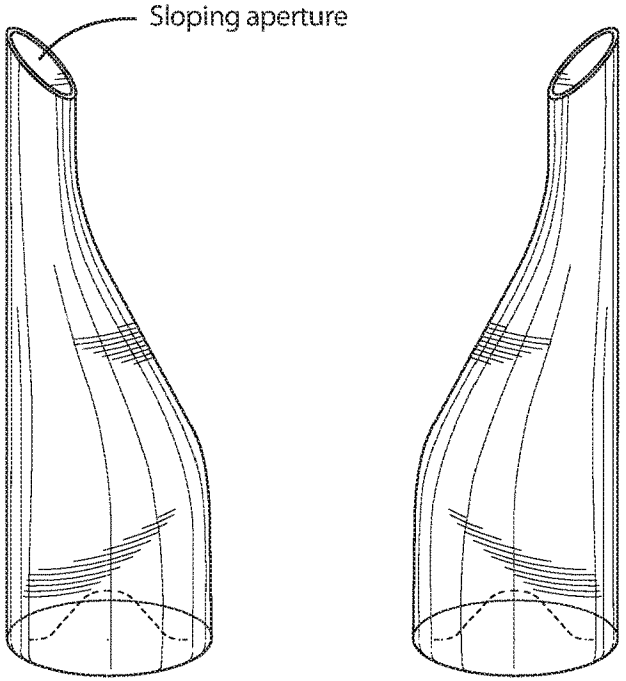
Figure 17
Figure 18
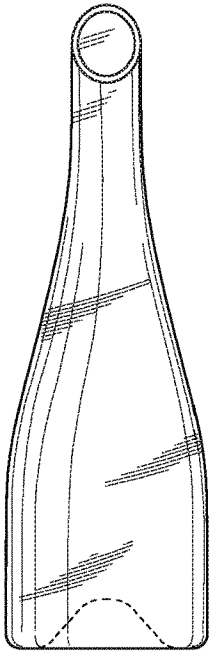
Figure 19
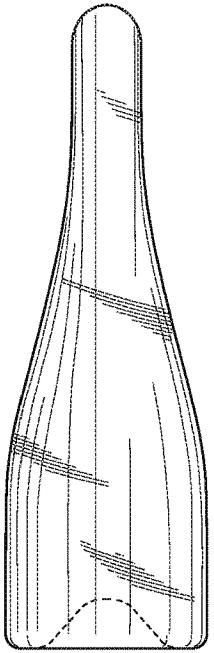
Figure 20

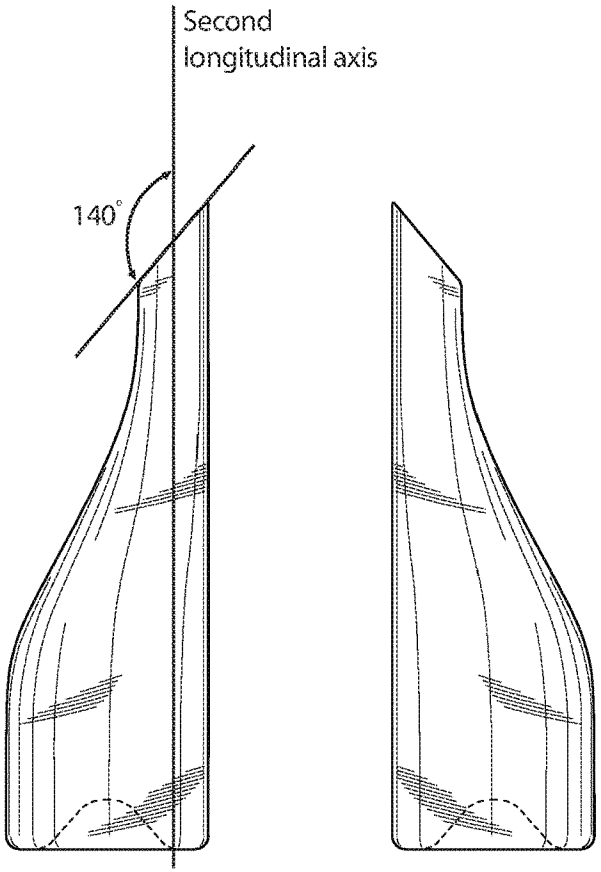
Figure 21
Figure 22
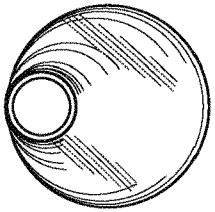
Figure 23
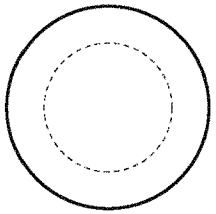
Figure 24

PRIOR ART

SET OF STACKABLE BOTTLES

CROSS REFERENCE TO RELATED APPLICATIONS

This application claims benefit of priority from U.S. Provisional Patent Application No. 61/949,875, filed Mar. 7, 2014, which is hereby incorporated by reference in its entirety herein.

BACKGROUND

Generally, the inventive techniques disclosed herein relate to a bottle for containing a fluid, such as wine, spirits, or water. In particular, the inventive techniques relate to a bottle with non-concentric body and neck portions that allow a plurality of the bottles to be stacked lengthwise more closely and more stably compared to bottles traditionally used to carry similar fluids. In addition, the inventive techniques relate to a sloping aperture that may enhance a user's control over the flow of fluids out of the bottle when a user tips the bottle to pour fluid.

Traditionally, a bottle used to contain fluids such as wine, spirits, or water has a neck portion concentric around a longitudinal axis with a body portion, and a shoulder portion that slopes towards the center of the bottle. The shape of such a bottle may prevent a plurality of such bottles from being stacked lengthwise head-to-toe such that they interlay and overlap. As a result, the shape of such a bottle may generally require a plurality of such bottles to be stacked lengthwise with their neck portions aligned in the same direction, which may generate a substantial volume of gap between a plurality of such bottles. Such a volume of gaps may require substantial capacity in shipping containers carrying such bottles. This, in turn, may lead to substantial cost and pre-consumption and post-consumption waste.

Therefore, it may be useful to provide a bottle apparatus that may reduce the volume of the gaps between the bottles when they are stacked lengthwise. For example, it may be useful to provide a bottle apparatus that has a shape that may allow a plurality of bottles to be stacked lengthwise head-to-toe such that they interlay and overlap. By interlaying and overlapping the bottles, the volume of gaps between the bottles may be reduced when the bottles are stacked lengthwise.

Further, a bottle traditionally comprises a flat aperture to allow fluids to travel in and out of the bottle.

Therefore, it may also be useful to provide a bottle apparatus that comprises a sloping aperture. A sloping aperture may reduce turbulence in the fluid flow during pouring. Thus, a sloping aperture may enhance the control that a user has over the flow of fluids when a user pours fluids out of the bottle. In addition, a sloping aperture may provide a visual cue that indicates to a user both the direction that the bottle should be poured from and the direction from which the user should hold the bottle. Sloping apertures with varied aesthetic appearances could be employed to achieve these advantages.

Additionally, a bottle traditionally used to contain fluids such as wine, spirits, or water lacks a substantially straight lateral surface that extends in substantially a single dimension for substantially the height of the bottle. Labels affixed to such a bottle are limited in their shape by the contours of the bottle. For example, it may not be possible to affix a contiguous label along substantially the height of the bottle because of the slope of the shoulder portion.

Therefore, it may additionally be useful to provide a bottle apparatus that comprises a substantially straight lateral surface that extends in substantially a single dimension for substantially the height of the bottle. A contiguous label that may have a length substantially equal to the height of the bottle may be affixed to such a lateral surface. Such a label could be used to display branding, product information, or measuring indicators (e.g., for measuring volume).

SUMMARY

According to certain inventive techniques, a bottle apparatus for storing a fluid includes a body region, a shoulder region, and a neck region, wherein the body region and neck region are not concentric when the bottle is viewed downwardly from above the upper end of the bottle. The shoulder region may include a sloping outer surface such that the bottle tapers towards its upper end. The neck region, a shoulder region, and the body region may share a substantially straight lateral surface that extends in substantially a single dimension for substantially the height of the bottle. A contiguous label that may have a length substantially equal to the height of the bottle may be affixed to a substantially straight lateral surface. The bottle may contain a sloping aperture in the upper portion of the neck region, proximate to or at the bottle's upper end.

BRIEF DESCRIPTION OF SEVERAL VIEWS OF THE DRAWINGS

FIGS. 1-8 illustrate different views of a bottle which is made according to certain inventive techniques. As illustrated, the bottle may be made from a transparent or translucent material.

FIGS. 17-24 illustrate different views of a bottle which is made according to certain inventive techniques, wherein the bottle comprises an example of a sloping aperture. As illustrated, the bottle may be made from transparent or translucent material.

Figure 1:
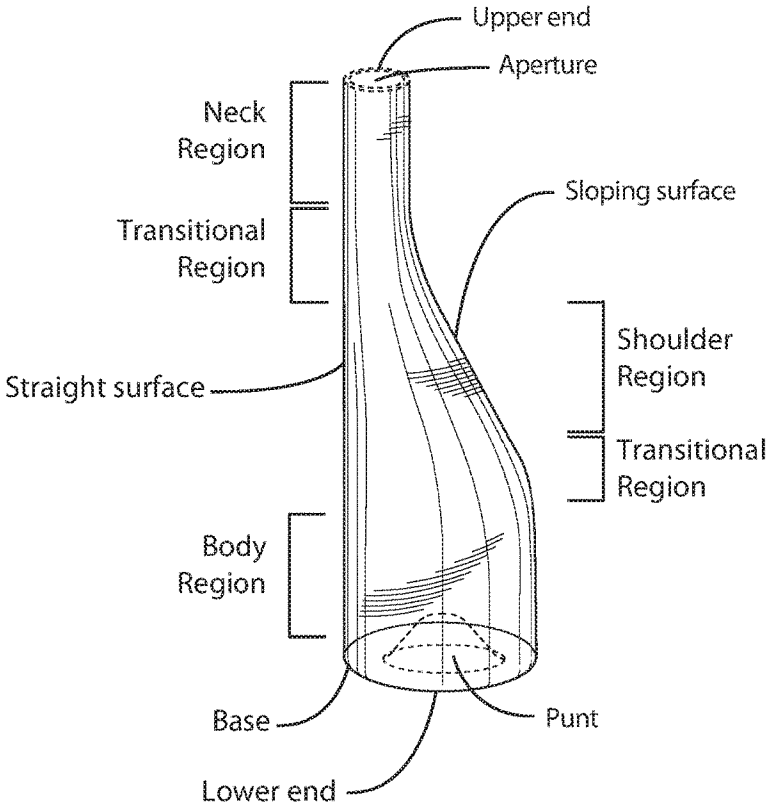

The foregoing summary, as well as the following detailed description of certain inventive techniques, will be better understood when read in conjunction with the appended drawings. For the purposes of illustration, certain techniques are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the apparatus. Specifically, the stated functions may be achieved with bottles having varied overall appearances, and varied constituent elements, including varied designs for bases, punts, body regions, shoulder regions, transitional regions, neck regions, and apertures.

DETAILED DESCRIPTION

Figure 2:
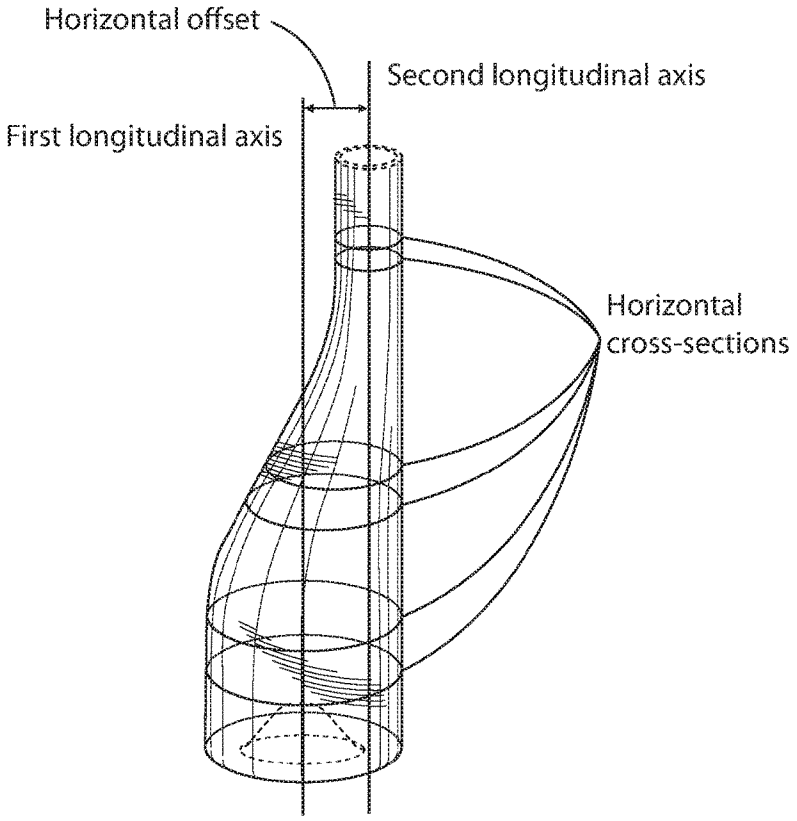
Figure 4:
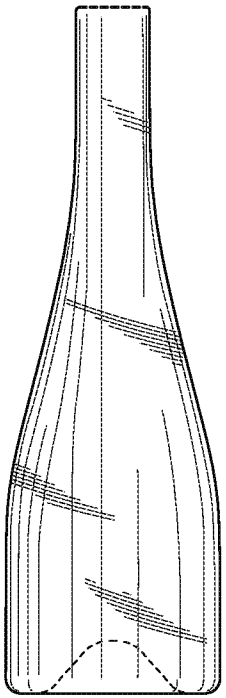
Figure 3:
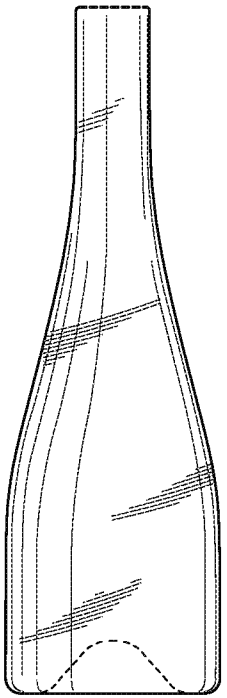

FIGS. 1-8 illustrate different views of a bottle which is made according to certain inventive techniques. FIGS. 1-2 show perspective views of the bottle. FIG. 3 shows a front view of the bottle. FIG. 4 shows a rear view of the bottle. FIGS. 5-6 show side views of the bottle. FIG. 7 shows a top view of the bottle. FIG. 8 shows a bottom view of the bottle.

According to certain inventive techniques disclosed herein, the bottle may be transparent, translucent, or opaque. The bottle may be made from various materials, including glass, plastic (e.g., PET), ceramic, stoneware, or metal. As shown in FIG. 2, the bottle may include a first longitudinal axis and a second longitudinal axis. The second longitudinal axis may be offset horizontally from the first longitudinal axis. As shown in FIG. 1, the bottle has an upper end and a lower end. The bottle may include a base at its lower end. The base may contain a punt that extends upwards into the bottle. The base may be centered around the first longitudinal axis. The second longitudinal axis may be configured such that it passes through the base. The bottle may include an aperture proximate to or at its upper end. The aperture is configured to allow fluid to travel in and out of the bottle. The bottle may comprise five regions: a body region, a first transitional region, a shoulder region, a second transitional region, and a neck region. Each region may have a horizontal cross-sectional profile defined by horizontal cross-sections within that region. The body region may extend upwardly from the base and be located between the base and the first transitional region. The body region may have a substantially constant horizontal cross-sectional profile. The body region may be centered around the first longitudinal axis. The body region may include a straight outer surface. The first transitional region may be located between the body region and the shoulder region. The first transitional region may comprise a curving outer surface, providing a transition from a straight outer surface of the body region to a sloping outer surface of the shoulder region. The shoulder region may extend upwardly from the first transitional region, and be located between the first transitional region and the second transitional region. The shoulder region may include a sloping outer surface, such that the horizontal cross-sectional profile of the shoulder region narrows as the shoulder region extends towards the upper end of the bottle. The sloping outer surface may not be curved (i.e., straight). The sloping outer surface may be at an angle of between 110 and 170 degrees relative to the first longitudinal axis. For example, the sloping outer surface may be at an angle of 155 degrees relative to the first longitudinal axis. The second transitional region may be located between the shoulder region and the neck region. The second transitional region may comprise a curving outer surface, providing a transition from a sloping outer surface of the shoulder region to a straight outer surface of the neck region. The neck region may extend upwardly from the second transitional region. The neck region may have a substantially constant horizontal cross-sectional profile. The neck region may be centered around the second longitudinal axis. According to certain inventive techniques, an upper portion of the neck region contains the aperture. The aperture may be proximate to or at the bottle's upper end. The bottle may include a substantially straight lateral surface parallel to the first longitudinal axis, wherein the lateral surface extends along the body region, the first transitional region, the shoulder region, the second transitional region, and the neck region for substantially the height of the bottle.

The lateral surface may be used to include contiguous labels that extend substantially the height of the bottle. Traditionally, bottles such as those used to carry wine, do not have such lateral surfaces. It may not be possible to affix a contiguous label along substantially the height of such bottles. According to certain inventive techniques disclosed herein, a contiguous label that may have a length substantially equal to the height of the bottle may be affixed to a lateral surface of the bottle. Alternatively, two or more shorter labels could be affixed to the lateral surface. Such a label or labels could be used to display branding, product information, or measuring indicators (e.g., for measuring volume).

The body region and neck region may each have a horizontal diameter. According to a certain inventive technique of the present invention, body region diameter may be approximately $3\frac{45}{64}$ inches and the neck region diameter may be approximately $1\frac{17}{64}$ inches. The ratio between the body region diameter and the neck region diameter may be approximately 79:27 or 2.9:1. Other ratios are possible, such as between 2:1 up to 5:1. Of course, with all limitations set forth herein, bottles with varying ornamental appearances may be designed while complying with said limitations.

A bottle according to certain inventive techniques may be defined in part by three axial segments: a first axial segment extending vertically through the body region; a second axial segment extending vertically and horizontally (i.e., diagonally) through the shoulder region; and a third axial segment extending vertically through the neck region.

The body region may have a substantially constant horizontal cross-sectional profile. The body region may have a horizontal cross-sectional profile that has a center axis that intersects the first axial segment. In other words, each horizontal cross-section in the body region may have a center that intersects the first axial segment.

The neck region may also have a substantially constant horizontal cross-sectional profile (although narrower than that of the body region). The neck region may have a horizontal cross-sectional profile that has a center axis that intersects the third axial segment. In other words, each horizontal cross-section in the neck region may have a center that intersects the third axial segment.

The shoulder region may have a horizontal cross-sectional profile that narrows in a direction moving away from the body region towards the neck region. The shoulder region may have a horizontal cross-sectional profile that has a center axis that intersects the second axial segment. In other words, each horizontal cross-section in the shoulder region may have a center that intersects the second axial segment. The second axial segment may be at an angle of between 145 and 175 degrees relative to the first axial segment. For example, the second axial segment may be at an angle of 167.5 degrees relative to the first axial segment.

The body region and the neck region are not concentric when viewed looking downwardly at the bottle from above the upper end.

Similar to FIGS. 1-8, FIGS. 9-16 illustrate different views of a bottle which is made according to certain inventive techniques. The bottle may be transparent, translucent, or opaque. The bottle illustrated in FIGS. 9-16 may be made from a different material than the bottle illustrated in FIGS. 1-8. The bottle may be made from various materials, including glass, plastic (e.g., PET), ceramic, stoneware, or metal.

Figure 12:
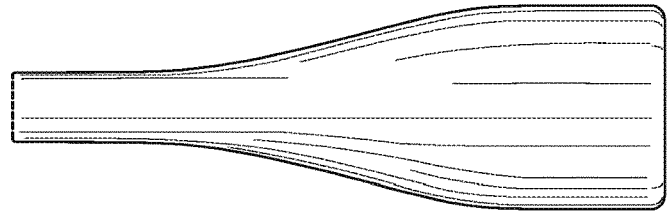
FIGS. 9-16 illustrate different views of a bottle which is made according to certain inventive techniques. As illustrated, the bottle may be made from an opaque material.
Figure 11:
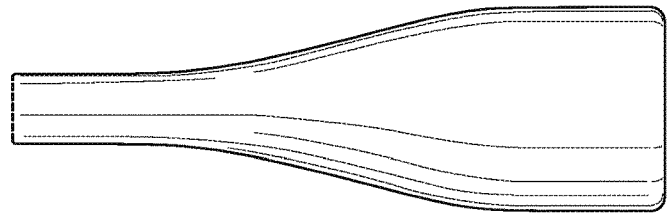
Figure 10:
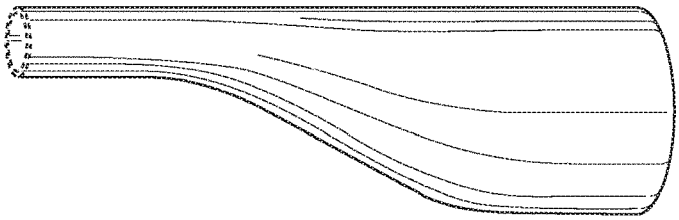
Figure 9:
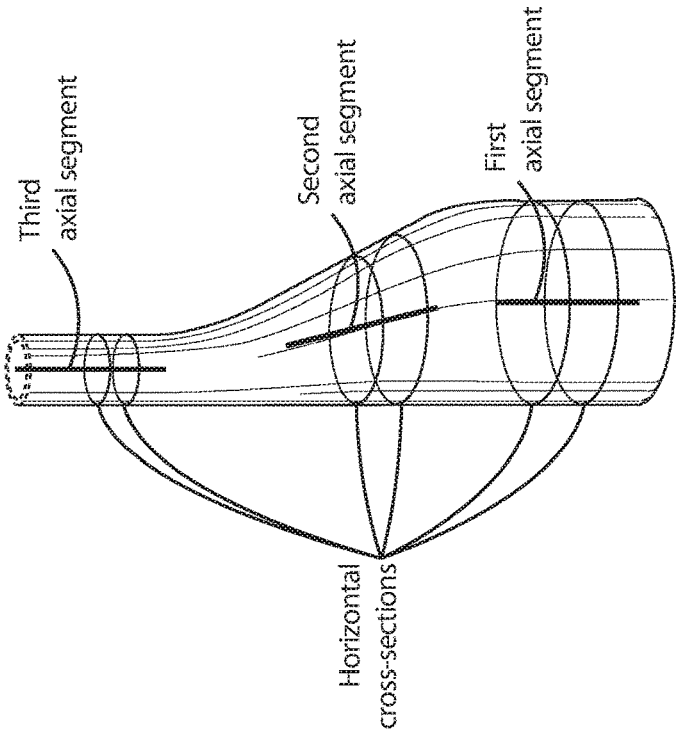
Figure 13:
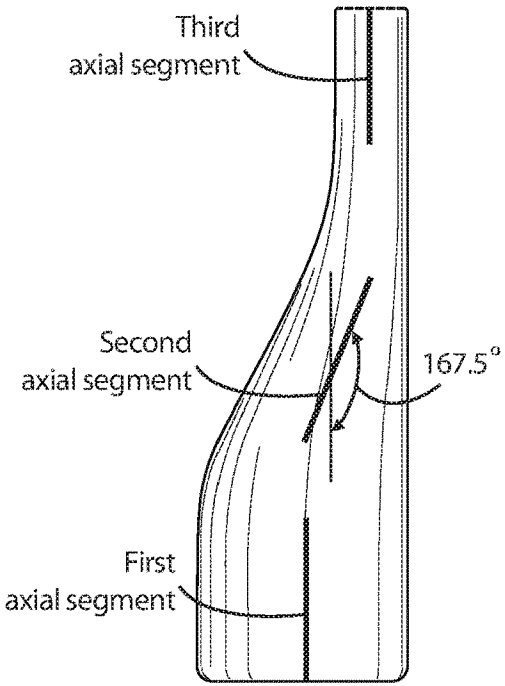
Figure 14:
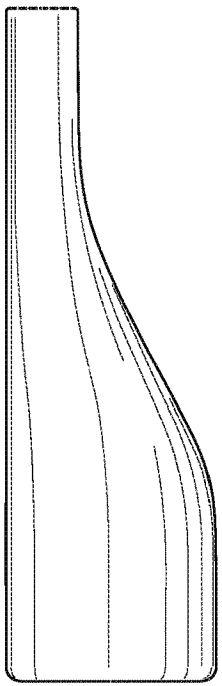
Figure 15:
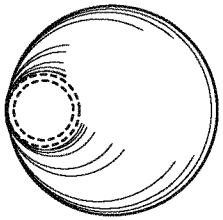
Figure 16:
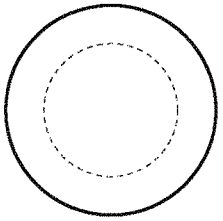

FIGS. 9-10 show perspective views of the bottle. FIG. 11 shows a front view of the bottle. FIG. 12 shows a rear view of the bottle. FIGS. 13-14 show side views of the bottle. FIG. 15 shows a top view of the bottle. FIG. 16 shows a bottom view of the bottle.

Similar to FIGS. 1-8, FIGS. 17-24 illustrate different views of a bottle which is made according to certain inventive techniques. The bottle may be transparent, translucent, or opaque. The bottle may be made from various materials, including glass, plastic (e.g., PET), ceramic, stoneware, or metal. In contrast to FIGS. 1-8, the bottle illustrated in FIGS. 17-24 includes a sloping aperture in the neck region that is sloping at an angle. The sloping aperture may be at an angle of between 120 and 160 degrees relative to the second longitudinal axis. For example, the sloping aperture may be at an angle of 140 degrees relative to the second longitudinal axis. A sloping aperture may reduce turbulence in the fluid flow during pouring. Thus, a sloping aperture may enhance the control that a user has over the flow of fluids when a user pours fluids out of the bottle. In addition, a sloping aperture may provide a visual cue that indicates to a user both the direction that the bottle should be poured from and the direction from which the user should hold the bottle. Sloping apertures with varied aesthetic appearances could be employed to achieve these advantages. The ornamental style of a sloping aperture is not limited to the ornamental style of the apertures disclosed herein. FIGS. 17-18 show perspective views of the bottle. FIG. 19 shows a front view of the bottle. FIG. 20 shows a rear view of the bottle. FIGS. 21-22 show side views of the bottle. FIG. 23 shows a top view of the bottle. FIG. 24 shows a bottom view of the bottle.

Figure 28:
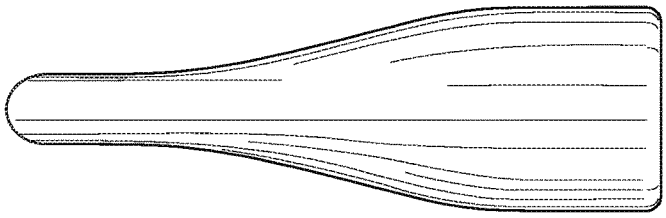
FIGS. 25-32 illustrate different views of a bottle which is made according to certain inventive techniques, wherein the bottle comprises an example of a sloping aperture. As illustrated, the bottle may be made from an opaque material.
Figure 27:
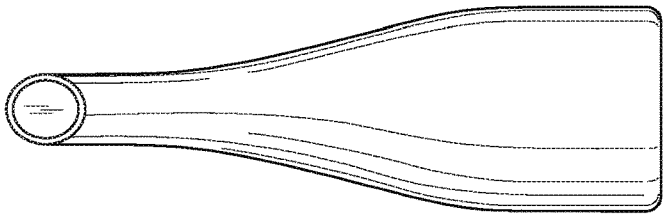
Figure 26:
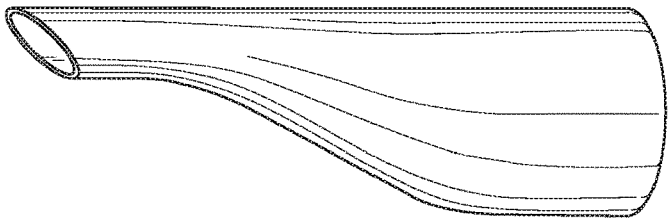
Figure 25:
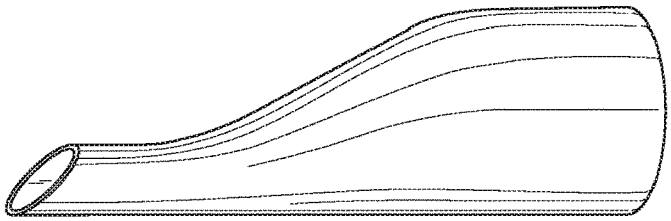
Figure 32:
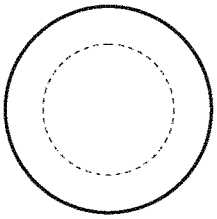
Figure 31:
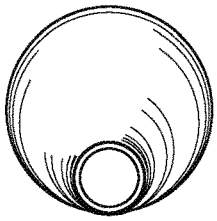
Figure 30:
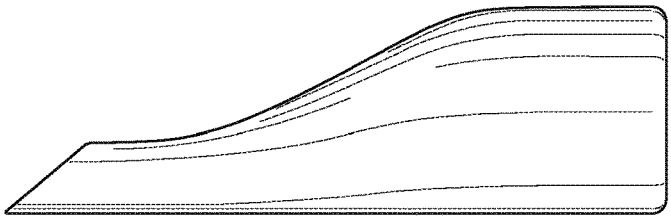
Figure 29:
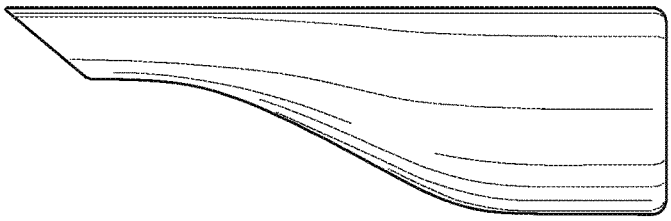

Similar to FIGS. 9-16, FIGS. 25-32 illustrate different views of a bottle which is made according to certain inventive techniques. The bottle may be transparent, translucent, or opaque. The bottle may be made from various materials, including glass, plastic (e.g., PET), ceramic, stoneware, or metal. In contrast to FIGS. 9-16, the bottle illustrated in FIGS. 25-32 includes a sloping aperture in the neck region that is at a sloping angle. The sloping aperture may be at an angle of between 120 and 160 degrees relative to the second longitudinal axis. For example, the sloping aperture may be at an angle of 140 degrees relative to the second longitudinal axis. FIGS. 25-26 show perspective views of the bottle. FIG. 27 shows a front view of the bottle. FIG. 28 shows a rear view of the bottle. FIGS. 29-30 show side views of the bottle. FIG. 31 shows a top view of the bottle. FIG. 32 shows a bottom view of the bottle.

Figure 33:
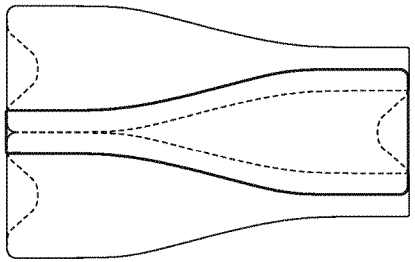
FIGS. 33-34 illustrate different views of three bottles that are stacked such that one bottle rests nested on top of two bottles, according to certain inventive techniques.
Figure 34:
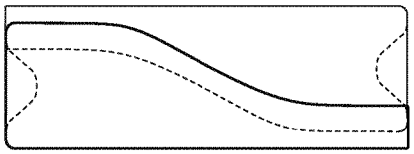
Figure 35:
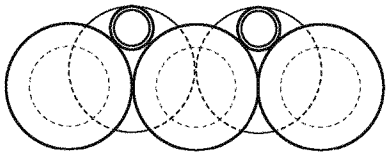
FIGS. 35-37 illustrate different views of ten bottles that are stacked in two rows of five bottles each, such that, in each row, two bottles rest nested on top of three bottles, according to certain inventive techniques.
Figure 36:
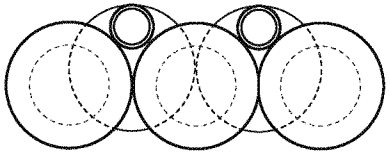
Figure 37:
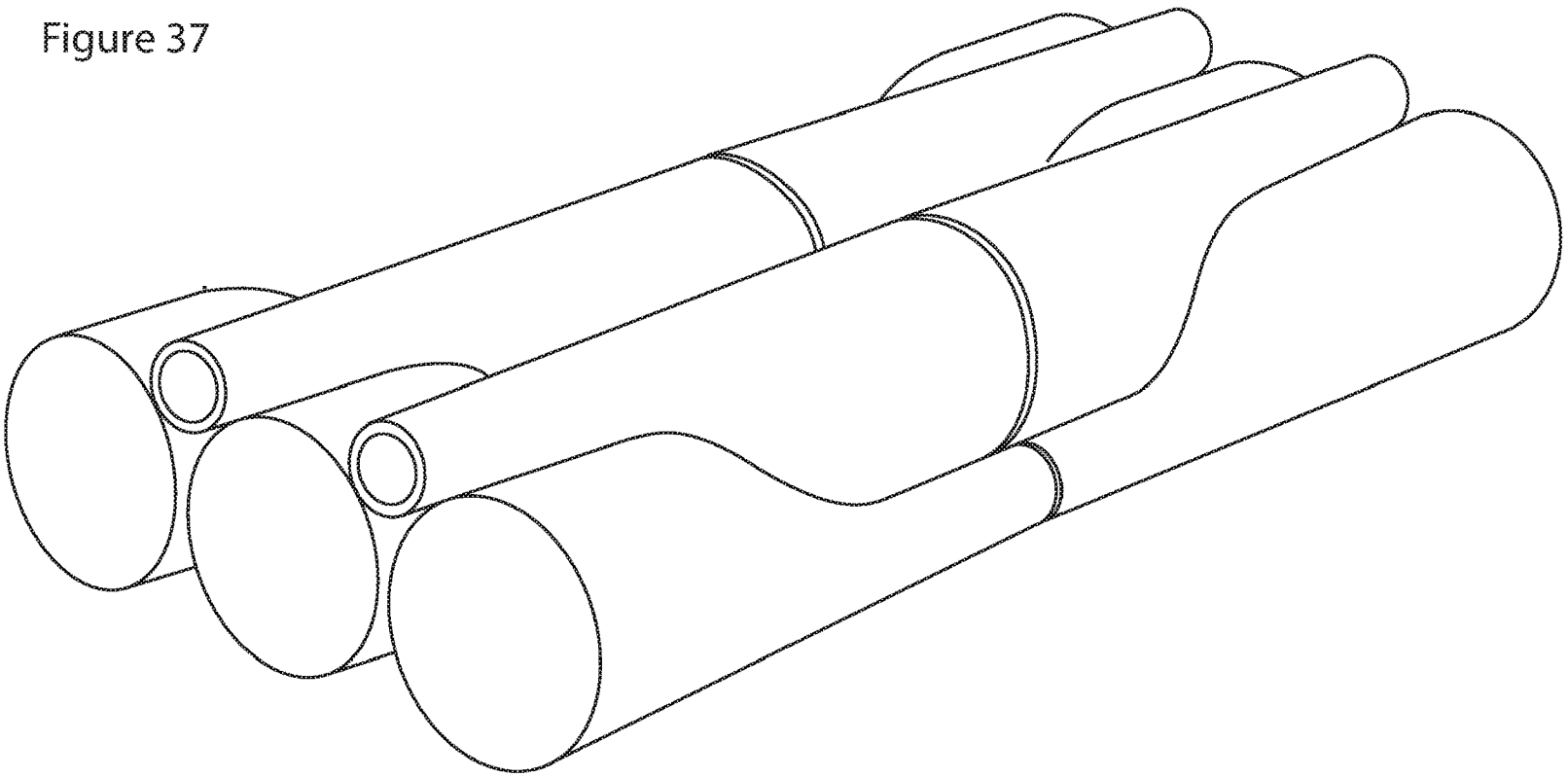
Figure 38:
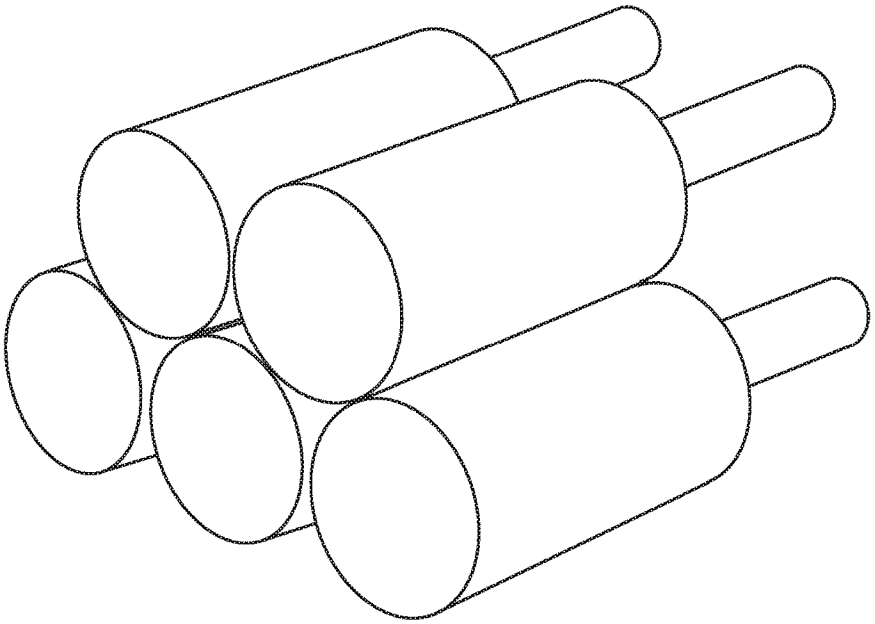
Figure 38 PRIOR ART
FIGS. 38-39 illustrate different views of five prior art bottles that are traditionally used to store a fluid such as wine, stacked in a row with two prior art bottles on top of three prior art bottles.
Figure 39:
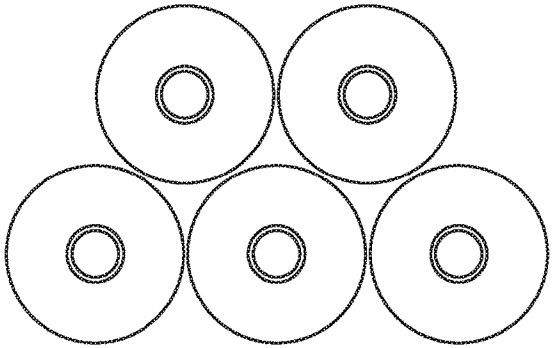

FIGS. 33-34 demonstrate how three bottles may be stacked lengthwise, according to certain inventive techniques, such that one bottle rests nesting head-to-toe on top of two bottles. FIG. 33 provides a stacking top view that shows how the bottles may interlay and overlap. FIG. 34 provides a stacking side view that shows how the bottles may interlay and overlap. FIGS. 35-37 demonstrate how ten bottles may be stacked lengthwise in two rows of five bottles each, according to certain inventive techniques, such that, in each row, two bottles rest nesting head-to-toe on top of three bottles. FIGS. 35-36 provide views from each end of the stacked bottles that shows how the bottles may interlay and overlap. FIG. 37 provides a perspective view of the stacked bottles that shows how the bottles may interlay and overlap. FIGS. 38-39 show how five prior art bottles may be stacked lengthwise in one row, such that two prior art bottles rest on top of three prior art bottles. FIG. 38 provides a perspective view of the stacked prior art bottles. FIG. 39 provides a view from an end closest to the necks of the stacked bottles. Prior art bottles used to contain fluids such as wine, spirits, or water—such as the bottles shown in FIGS. 38-39—have a neck portion concentric around a longitudinal axis with a body portion, and a shoulder portion that slopes towards the center of the bottle. The shape of such a bottle may prevent a plurality of such bottles from being stacked lengthwise head-to-toe such that they interlay and overlap. As a result, the shape of such a bottle may generally require a plurality of such bottles to be stacked lengthwise with their neck portions aligned in the same direction, which may generate a substantial volume of gap between a plurality of such bottles. Such a volume of gaps may require substantial capacity in shipping containers carrying such bottles. This, in turn, may lead to substantial cost and pre-consumption and post-consumption waste. FIGS. 33-37 demonstrate how certain inventive techniques may reduce the volume of gaps between bottles when the bottles are stacked lengthwise. For example, it may be useful to provide a bottle apparatus that has a shape that may allow a plurality of bottles to be stacked lengthwise head-to-toe such that they interlay and overlap. By interlaying and overlapping the bottles, the volume of gaps between the bottles may be reduced when the bottles are stacked lengthwise. Reducing the volume of gaps may provide advantages in terms of reducing the cost and volume of shipments both when bottles are shipped out, e.g., to a distributor of wine contained in the bottles; and when the bottles are returned, e.g., to a recycling facility. Reducing the volume of gaps may also provide similar advantages during storage of bottles, because the certain inventive techniques disclosed herein may allow for a greater number of bottles to be stored in container of a given volume.

It will be understood by those skilled in the art that various changes may be made and equivalents may be substituted without departing from the scope of the novel techniques disclosed herein. In addition, many modifications may be made to adapt a particular situation or material to the teachings of the novel techniques without departing from its scope. Therefore, it is intended that the novel techniques not be limited to the particular techniques disclosed, but that they will include all techniques falling within the scope of the appended claims.

The invention claimed is:

1. A set of bottles comprising:

a first, a second, and a third bottle, each of the bottles including:

an upper end and a lower end;

a first longitudinal axis and a second longitudinal axis, wherein the second longitudinal axis is offset horizontally from the first longitudinal axis;

a base at the lower end of the bottle, wherein the base is centered around the first longitudinal axis;

a body region, wherein the body region is centered around the first longitudinal axis, extends upwardly from the base, has a substantially constant, substantially circular horizontal exterior cross-sectional profile along the height of the body region, and has a perimeter defined by a substantially constant radius from the first longitudinal axis;

a shoulder region extending upwardly from the body region, wherein the shoulder region has a substantially circular horizontal exterior cross-sectional profile that narrows as the shoulder region extends towards the upper end of the bottle, and wherein the shoulder region includes a sloping outer surface;

a first transitional region, wherein the first transitional region is located between the body region and the shoulder region;

a neck region, wherein the neck region is centered around the second longitudinal axis, extends upwardly from the shoulder region, has a substantially constant, substantially circular horizontal exterior cross-sectional profile along the height of the neck region, and has a perimeter defined by a substantially constant radius from the second longitudinal axis;

a second transitional region, wherein the second transitional region is located between the shoulder region and the neck region; and an aperture in an upper portion of the neck region, wherein the aperture is configured to allow fluid to travel in and out of the bottle;

wherein the first and second bottles are positioned adjacent to each other with at least a portion of the body region of the first bottle contacting at least a portion of the body region of the second bottle, wherein the third bottle is positioned in a head-to-toe configuration on top of the first and second bottles such that the upper end of the third bottle is substantially aligned in a plane with the lower ends of the first and second bottles and that the lower end of the third bottle is substantially aligned in a plane with the upper ends of the first and second bottles, wherein at least a first portion of the sloping outer surface of the shoulder region of the third bottle contacts at least a portion of the sloping outer surface of the shoulder region of the first bottle, and wherein at least a second portion of the sloping outer surface of the shoulder region of the third bottle contacts at least a portion of the sloping outer surface of the shoulder region of the second bottle.

2. The set of bottles of claim 1, wherein each bottle further comprises:

a first transitional region, wherein the first transitional region is located between the body region and the shoulder region, and wherein the first transitional region includes a curving outer surface; and a second transitional region, wherein the second transitional region is located between the shoulder region and the neck region, and wherein the second transitional region includes a curving outer surface.

3. The set of bottles of claim 1, wherein the sloping outer surface of the shoulder region of each bottle includes an angle comprising between 110 and 170 degrees relative to the first longitudinal axis.

4. The set of bottles of claim 3, wherein the angle comprises approximately 155 degrees relative to the first longitudinal axis.

5. The set of bottles of claim 1, wherein each bottle includes a lateral surface parallel to the first longitudinal axis, wherein the lateral surface extends along the body region, the shoulder region, and the neck region for substantially the height of each bottle.

6. The set of bottles of claim 1, wherein the base of each bottle contains a punt extending along the first longitudinal axis towards the body region of each bottle.

7. The set of bottles of claim 1, wherein the aperture of each bottle is sloping across an upper portion of the neck region relative to the second longitudinal axis.

8. The set of bottles of claim 7, wherein the aperture of each bottle is sloping at an angle comprising between 120 and 160 degrees relative to the second longitudinal axis.

9. The set of bottles of claim 7, wherein the aperture of each bottle is sloping at an angle comprising approximately 140 degrees relative to the second longitudinal axis.

10. A set of bottles comprising:

a first, a second, and a third bottle, wherein each bottle is defined by a first axial segment extending vertically, a second axial segment extending vertically and horizontally from above the first axial segment, and a third axial segment extending vertically from above the second axial segment and horizontally offset from the first axial segment, wherein each bottle includes:

an upper end and a lower end;

a body region extending upwardly from the lower end, wherein the body region has a substantially constant, substantially circular horizontal exterior cross-sectional profile along the height of the body region and is centered around the first axial segment at a substantially constant radius from the first axial segment;

a shoulder region extending upwardly from the body region, wherein the shoulder region has a narrowing, substantially circular horizontal exterior cross-sectional profile in an upward direction along the as the height of the shoulder region increases, wherein each horizontal cross-section in the shoulder region has a center that intersects with the second axial segment;

a first transitional region, wherein the first transitional region is located between the body region and the shoulder region;

a neck region extending upwardly from the shoulder region, wherein the neck region has a substantially constant, substantially circular horizontal exterior cross-sectional profile along the height of the neck region and is centered around the third axial segment at a substantially constant radius from the third axial segment;

a second transitional region, wherein the second transitional region is located between the shoulder region and the neck region; and wherein the first and second bottles are positioned adjacent to each other with at least a portion of the body region of the first bottle contacting at least a portion of the body region of the second bottle, wherein the third bottle is positioned in a head-to-toe configuration on top of the first and second bottles such that the upper end of the third bottle is substantially aligned in a plane with the lower ends of the first and second bottles and that the lower end of the third bottle is substantially aligned in a plane with the upper ends of the first and second bottles, wherein at least a first portion of the sloping outer surface of the shoulder region of the third bottle contacts at least a portion of the sloping outer surface of the shoulder region of the first bottle, and wherein at least a second portion of the sloping outer surface of the shoulder region of the third bottle contacts at least a portion of the sloping outer surface of the shoulder region of the second bottle.

11. The set of bottles of claim 10, wherein each bottle further comprises:

a first transitional region, wherein the first transitional region is located between the body region and the shoulder region, and wherein the first transitional region includes a curving outer surface; and a second transitional region, wherein the second transitional region is located between the shoulder region and the neck region, and wherein the second transitional region includes a curving outer surface.

12. The set of bottles of claim 10, wherein the second axial segment is at an angle comprising between 145 and 175 degrees relative to the first axial segment.

13. The set of bottles of claim 12, wherein the angle comprises 167.5 degrees relative to the first axial segment.

14. The set of bottles of claim 10, wherein each bottle includes a lateral surface parallel to the first axial segment that extends along the body region, the shoulder region, and the neck region for substantially the height of each bottle.

15. The set of bottles of claim 10, wherein each bottle contains a punt extending upwards from the lower end along the first axial segment.

16. The set of bottles of claim 10, wherein the neck region contains an aperture configured to allow fluid to travel in and out of each bottle.

17. The set of bottles of claim 16, wherein the aperture of each bottle is sloping across an upper portion of the neck region relative to the third axial segment.

18. The set of bottles of claim 16, wherein the aperture of each bottle is sloping across an upper portion of the neck region at an angle comprising between 120 and 160 degrees relative to the third axial segment.

19. The set of bottles of claim 16, wherein the aperture of each bottle is sloping at an angle comprising approximately 140 degrees relative to the third axial segment.

* * * * *